US008013265B1

(12) United States Patent
Fujita et al.

(10) Patent No.: US 8,013,265 B1
(45) Date of Patent: Sep. 6, 2011

(54) SWITCH DEVICE

(75) Inventors: Kazuhisa Fujita, Fukui (JP); Mikio Nishimura, Fukui (JP); Shigetaka Douzono, Fukui (JP); Kouichi Santo, Fukui (JP); Kenji Otomo, Fukui (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/043,887

(22) Filed: Mar. 9, 2011

(30) Foreign Application Priority Data

Mar. 15, 2010 (JP) ..... 2010-057068

(51) Int. Cl.
*H01H 9/02* (2006.01)

(52) U.S. Cl. ..... 200/293

(58) Field of Classification Search ..... 200/293
See application file for complete search history.

(56) References Cited

U.S. PATENT DOCUMENTS

| | | | | |
|---|---|---|---|---|
| 4,135,171 | A * | 1/1979 | Violet | 366/60 |
| 6,791,046 | B1 * | 9/2004 | King | 200/293 |
| 2008/0210046 | A1 * | 9/2008 | De Perini | 74/502.2 |

FOREIGN PATENT DOCUMENTS

| | | |
|---|---|---|
| JP | 2007-257979 | 10/2007 |

* cited by examiner

*Primary Examiner* — Gary F. Paumen
(74) *Attorney, Agent, or Firm* — Panasonic Patent Center; Dhiren Odedra; Kerry Culpepper

(57) ABSTRACT

A switch device includes a box-shaped case, a harness portion, and a fixing member. The harness portion is connected to a switch contact point and includes a plurality of lead lines extending out of the case. The case includes a holding body and a guide portion. The holding body includes a fixing portion protruding from an outer face of the case and provided on a tip side, and a through-hole provided under the fixing portion. The guide portion is opposed to the through-hole and formed in a substantially concave curve shape. The guide portion is formed such that an end portion further from the through-hole is positioned to be above an end portion closer to the through-hole. The fixing member extends through the through-hole and fixes the harness portion to the holding body by winding the harness portion and the fixing portion together.

5 Claims, 6 Drawing Sheets

SWITCH DEVICE

BACKGROUND OF THE INVENTION

1. Field of the Invention

The present invention relates to a switch device mainly used to operate various electronic devices in a vehicle.

2. Background Art

In recent years, there have been more vehicles in which switches of various operation types are mounted on a steering wheel or a front panel, and various electronic devices such as air conditioners and audio devices in the vehicle are operated by the switch devices. Generally, in such switch devices, there extend a plurality of lead lines electrically connected from a rear side to a vehicle body. In a state where the lead lines are kept and fixed at a predetermined position of the switch device by a binding band, the switch devices are mounted in the vicinity of the steering wheel or in a limited housing space of the front panel (for example, see Japanese Patent Unexamined Publication No. 2007-257979).

Such a switch device of the prior art will be described with reference to FIG. 4 to FIG. 6C. FIG. 4 is a cross-sectional view illustrating the rear side of the switch device of the prior art which is disposed upward. FIG. 5A and FIG. 5B are perspective views illustrating the switch device of the prior art. FIG. 6A to FIG. 6C are cross-sectional views illustrating the main parts of the switch device of the prior art. In the following description, the front face and the front side indicate the lower side in the drawings, and the rear face and the rear side indicate the upper side in the drawings.

The switch device includes front case 101, operation body 102, intermediate case 103, wiring board 104, push switch 105, press pin 106, connector 107, lead lines 108, insulating tube 109, rear case 111, holding body 112, and binding band 113. Front case 101 is formed of an insulating resin, is substantially a box shape, and has a passage on the rear side. Operation body 102 is mounted on the front side of front case 101 to be movable up and down. Intermediate case 103 is formed of an insulating resin, and is provided to cover the passage on the rear side of front case 101. Wiring board 104 is provided with a plurality of wiring patterns (not shown) on the upper and lower faces thereof. Push switch 105 is mounted on the upper face of wiring board 104 as an automatic returning switch contact point. Press pin 106 is inserted into intermediate case 103 and is guided, and both ends thereof come in contact with the rear face of operation body 102 and press button 105A of push switch 105, respectively. As a result, electrical connection and disconnection of push switch 105 is performed through press pin 106 according to the operation of operation body 102. Connecter 107 is mounted on the rear face of wiring board 104. One end of the plurality of lead lines 108 is fixed to connector 107, and the other end is inserted into insulating tube 109. Harness portion 110 is formed from lead lines 108 and insulating tube 109.

Rear case 111 is formed of an insulating resin, and covers the rear side of intermediate case 103 and wiring board 104. Harness portion 110 extends outward from opening portion 111A of rear case 111. The other end of lead lines 108 of harness portion 110 is connected to an electronic circuit of a vehicle to control an electronic device such as an audio device according to the operation of operation body 102.

Holding body 112 protrudes from the rear face of rear case 111, and is formed in a substantially reverse L-shape. Fixing portion 112A provided to extend substantially parallel to the rear face of rear case 111 is formed at the upper part of holding body 112.

Binding band 113 is formed of an insulating resin such as polyamide, and is provided with fastener portion 113A having engagement hole 113C therein in a substantially rectangular shape at one end thereof. Band portion 113B provided with locking portion 113D with a substantially sawtooth-shaped cross section on the front face in a band shape extends from fastener portion 113A.

In the switch device of the prior art, a state where harness portion 110 extends outward from rear case 111 as shown in FIG. 5A becomes a state where harness portion 110 is fixed to rear case 111 by binding band 113 and holding body 112 as shown in FIG. 5B. Specifically, a user allows harness portion 110 to approach fixing portion 112A of holding body 112, and winds it by band portion 113B to be fastened. Band portion 113B is inserted into engagement hole 113C of fastener portion 113A, and locking portion 113D is locked to engagement hole 113. Accordingly, harness portion 110 is fixed to a predetermined position of holding body 112.

To fix harness portion 110 to holding body 112 using binding band 113, first, as shown in FIG. 6A, the user allows band portion 113B to pass through from the right side of fixing portion 112A to the lower portion of fixing portion 112A and harness portion 110.

As shown in FIG. 6B, harness portion 110 moved to the left side of fixing portion 112A and fixing portion 112A are wound by band portion 113B, and then are tightly fastened by passing band portion 113B through engagement hole 113C of fastener portion 113A. As shown in FIG. 6C, with locking portion 113D locked to engagement hole 113C, an unnecessary part of a tip of band portion 113B is cutoff, and harness portion 110 is fixed to fixing portion 112A of holding body 112 by binding band 113.

The switch device having the configuration described above is mounted, for example, on a spoke portion in the vicinity of a steering wheel, and an electric signal corresponding to an operation is output from push switch 105 to the electronic circuit of the vehicle through lead lines 108 by operating any of the plurality of operation bodies 102 with a finger with the handle held, to control the electronic device such as an audio device in the vehicle.

However, when the tip of band portion 113B is inserted into engagement hole 113C while band portion 113B is wound upward by passing band portion 113B through the lower portion of fixing portion 112A and harness portion 110, it is necessary to wind band portion 113B extending in a linear shape by about 270° or more with one hand while holding fastener portion 113A with the other hand. For this reason, time is spent on a fixing operation of harness portion 110 to fixing portion 112A by binding band 113. In addition, in handling such as the transport of the switch device and installation of the switch device to a vehicle, binding band 113 may become dislodged forward and backward from fixing portion 112A, or rotate left and right to easily cause a positional deviation of harness portion 110, and the fixing of harness portion 110 to holding body 112 may not be stable.

SUMMARY OF THE INVENTION

A switch device includes a box-shaped case, an operation body, a switch contact point, a harness portion, and a fixing member. The operation body is housed in the case to expose at least a part thereof out of the case. The switch contact point performs electrical connection and disconnection according to an operation of the operation body. The harness portion is connected to the switch contact point and includes a plurality of lead lines extending out of the case. The fixing member fixes the harness portion extending out of the case to the case.

The case includes a holding body and a guide portion. The holding body includes a fixing portion provided on the tip side, and a through-hole provided under the fixing portion. The guide portion is opposed to the through-hole and formed in a substantially concave curve shape. The guide portion is formed such that an end portion further from the through-hole is positioned above an end portion closer to the through-hole. The fixing member extends through the through-hole and fixes the harness portion to the holding body by winding the harness portion and the fixing portion together.

DETAILED DESCRIPTION OF PREFERRED EMBODIMENTS

Figure 1:
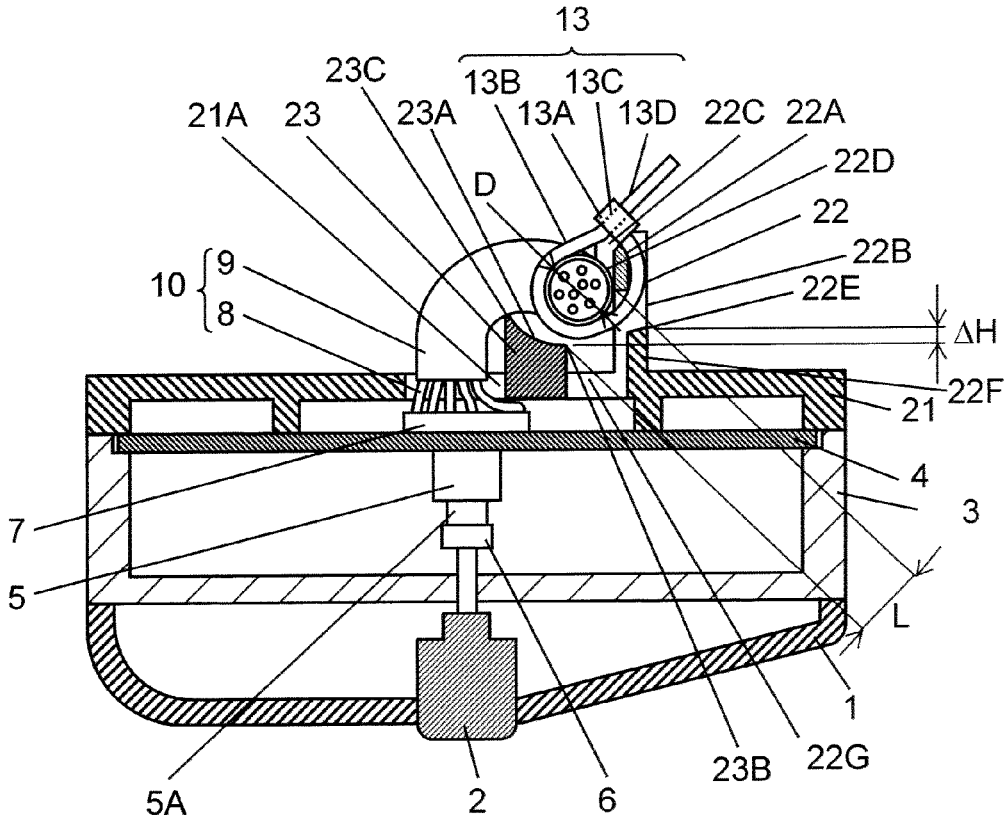
FIG. 1 is a cross-sectional view illustrating a switch device according to an embodiment of the invention.
Figure 2A:
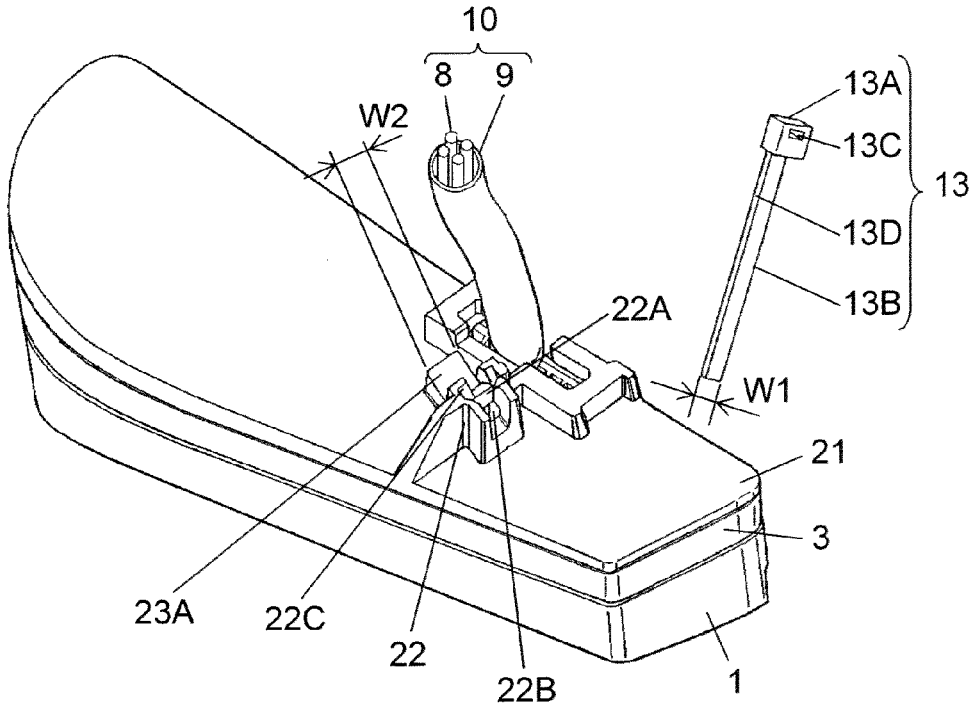
FIG. 2A and FIG. 2B are perspective views of the switch device according to the embodiment of the invention.
Figure 2B:
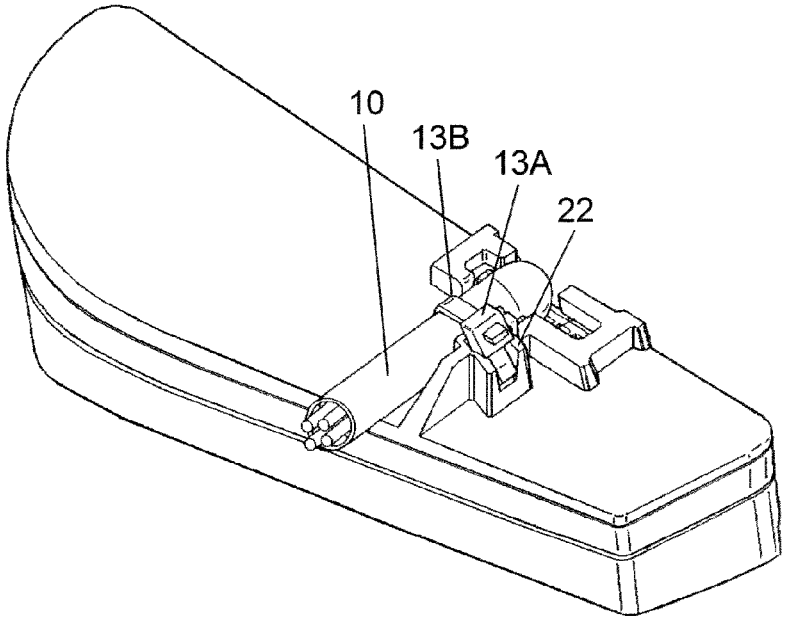

FIG. 1 is a cross-sectional view in which the rear side of the switch device of the embodiment is arranged upward. FIG. 2A and FIG. 2B are perspective views in which the rear side of the switch device of the embodiment is arranged upward. FIG. 3A to FIG. 3D are cross-sectional views of the main parts of the switch device of the embodiment. In the following description, the front face and the front side indicate the lower side in the drawings, and the rear face and the rear side indicate the upper side in the drawings. The up, down, left, and right directions in the following description indicate directions in the drawings, to describe positional relationships among constituent elements of the switch device of the embodiment. Accordingly, the invention is not necessarily limited to the directions.

Switch device includes front case 1, operation body 2, intermediate case 3, wiring board 4, push switch 5, press pin 6, connector 7, harness portion 10, binding band 13, rear case 21, holding body 22, and guide body 23. Front case 1, intermediate case 3, and rear case 21 constitute a box-shaped case.

Front case 1 is substantially formed in a box-shape and has an opening on the rear face. Front case 1 is formed of an insulating resin such as ABS (Acrylonitrile Butadiene Styrene). Intermediate case 3 is formed of an insulating resin such as ABS like the front case, and is provided to cover the opening portion of the rear face of front case 1. Rear case 21 is formed of an insulating resin such as polybutylene terephthalate, and covers the rear side of intermediate case 3 and wiring board 4.

Operation body 2 is housed in the case such that at least a part thereof is exposed to the outside of the case. A plurality of operation bodies 2 are mounted on the front side of front case 1 to be movable up and down. Wiring board 4 is formed of an insulating resin such as paper phenol resin and glass-incorporated epoxy resin, on the upper and lower faces of which a plurality of wiring patterns (not shown) are formed. Push switch 5 that is a switch contact point is mounted on the upper face of wiring board 4. Push switch 5 performs electrical connection and disconnection according to the operation of operation body 2 by a user. Press pin 6 is guided to be movable up and down in intermediate case 3, and comes into contact with the rear face of operation body 2 and press button 5A of push switch 5 to perform the electrical connection and disconnection of push switch 5 through press pin 6 according to the operation of operation body 2. Connector 7 is mounted on the rear face of wiring board 4.

Harness portion 10 includes a plurality of lead lines 8 and insulating tube 9. One end of lead lines 8 is connected to push switch 5, and the other end extends out of the case. One end of the plurality of lead lines 8 is fixed to connector 7, and the other end is inserted into insulating tube 9. Harness portion 10 extends outward from opening portion 21A of rear case 21, and the other end side of lead lines 8 is connected to an electronic circuit of a vehicle or the like. Accordingly, an electronic device such as an audio device is controlled according to the operation of operation body 2.

Binding band 13 that is a fixing member fixes harness portion 10 and the case. In the embodiment, a resinous binding band is used as the fixing member.

Rear case 21 includes substantially columnar holding body 22 protruding from the outer face of rear case 21, and substantially concave curve guide portion 23A. Holding body 22 protrudes from the rear face of rear case 21. Holding body 22 includes fixing portion 22A provided on the tip side of holding body 22 and through-hole 22B provided under fixing portion 22A. Fixing portion 22A is provided with concave holding portions 22C in a substantially V shape in the cross-sectional view on the upper face of the front-back direction. Substantially V-shaped support portion 22D with an obtuse angle formed by an inclination portion of the lower face of holding portions 22C and a vertical portion of the left face of fixing portion 22A is provided on the left side of fixing portion 22A above through-hole 22B.

Guide body 23 protrudes from the rear face of rear case 21, and is formed in a substantially columnar shape. Guide body 23 is provided on the left side of holding body 22 with a predetermined gap therebetween. Guide portion 23A is formed on the upper face of guide body 23. Guide portion 23A is formed to be opposed to through-hole 22B. Guide portion 23A is formed such that inclination on the upside gets larger as it gets farther away from through-hole 22B. In other words, end portion 23C of guide portion 23A far away from through-hole 22B is positioned to be above end portion 23B close to through-hole 22B. The right face of fixing portion 22A and left face of wall portion 22E of holding body 22 are formed on the same plane perpendicular to the rear face of rear case 21. Rear case 21 is provided with hole 22G connecting the front and back of rear case 21 between the left end of holding body 22 and the right end of guide body 23.

Binding band 13 fixes harness portion 10 to holding body 22 by winding harness portion 10 and fixing portion 22A through through-hole 22B. Binding band 13 is formed of an insulating resin such as polyamide, and has band portion 13B and fastener portion 13A. Band portion 13B is provided with locking portion 13D with a substantially sawtooth-shaped cross section on the front face in a band shape. Fastener portion 13A provided with engagement hole 13C therein in a substantially rectangular shape is provided at one end of band portion 13B. As shown in FIG. 1, guide portion 23A is opposed to support portion 22D of holding body 22 with harness portion 10 and binding band 13 interposed therebetween.

Lower end portion 22E of through-hole 22B is positioned to be above end portion 23B (the right side in FIG. 1) of opposed guide portion 23A close to through-hole 22B. Difference ΔH in height between end portion 23B of guide portion 23A and lower end portion 22E of through-hole 23B is preferably, for example, about 1 mm to 3 mm.

Gap L at a part where fixing portion 22A and guide portion 23A are closest is smaller than diameter D of harness portion 10. Accordingly, harness portion 10 is reliably placed between guide portion 23A and fixing portion 22A, and harness portion 10 can be easily fixed to holding body 22.

As shown in FIG. 2A, an interval of holding portions 22C of the front-back direction and a width of thorough-hole 22B are slightly larger than width W1 of binding band 13. Width W2 of guide portion 23A in the front-back direction is about 5 mm which is about double width W1 of binding band 13.

The switch device of the embodiment is configured such that, from a state where harness portion 10 extends out of rear case 21 as shown in FIG. 2A, harness portion 10 is fixed to rear case 21 as shown in FIG. 2B. FIG. 2B shows the state where harness portion 10 is fixed to holding body 22. Harness portion 10 is moved toward fixing portion 22A of holding body 22, and can be wound by band portion 13B to be tightly fastened. Band portion 13B wound on harness portion 10 and fixing portion 22A is fixed in a manner that an end portion at which fastener portion 13A is not provided is inserted into engagement hole 13C of fastener portion 13A, and locking portion 13D of band portion 13B is locked to engagement hole 13C. As a result, harness portion 10 is fixed at a predetermined position of holding body 22 to configure the switch device.

Figure 3A:
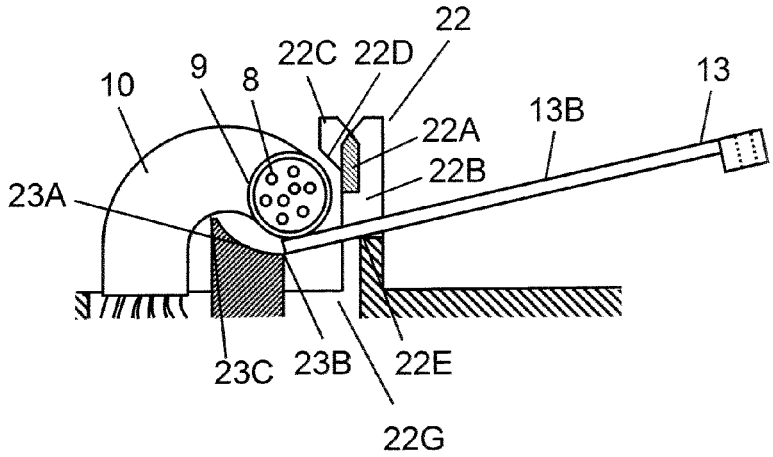
FIG. 3A, FIG. 3B, FIG. 3C, and FIG. 3D are cross-sectional views of the main parts of the switch device according to the embodiment of the invention.

Next, a method of fixing harness portion 10 to holding body 22 by binding band 13 will be described with reference to FIG. 3A to FIG. 3D. FIG. 3A to FIG. 3D are cross-sectional views of the main parts of the switch device of the embodiment. FIG. 3A to FIG. 3D are cross-sectional views for each process of fixing harness portion 10 to holding body 22. First, as shown in FIG. 3A, band portion 13B of binding band 13 is inserted from the right side to through-hole 22B, and passes through the lower portion of fixing portion 22A and harness portion 10.

At this time, since lower end portion 22E of through-hole 22B is positioned to be above right end portion 23B of guide portion 23A, band portion 13B does not easily hit end portion 23B, and can be smoothly moved from through-hole 22B onto left guide portion 23A.

Figure 3B:
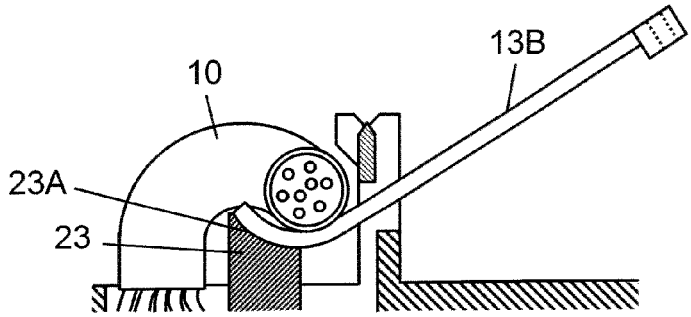

As shown in FIG. 3B, when band portion 13B is further inserted between harness portion 10 and guide portion 23A to the left side, band portion 13B is curved upward along substantially concave curve-shaped guide portion 23A. The tip portion of upward curved band portion 13B is wound around harness portion 10 as shown in FIG. 3C.

At this time, since band portion 13B is curved along the curved face of guide portion 23A and is drawn out upward, a space into which a finger of a user can be inserted is formed between band portion 13B and rear case 21. Accordingly, it is not necessary to hold up the tip of band portion 13B coming into contact with or approaching the upper face of the rear case as described in the prior art. As a result, it is possible to easily and rapidly wind band portion 13B around harness portion 10 and fixing portion 22A.

Since width W2 of guide portion 23A is larger than width W1 of band portion 13B, band portion 13B inserted into through-hole 22B is reliably led to guide portion 23A and is curved upward even when band portion 13B is slightly oblique with respect to guide portion 23A.

Figure 3C:
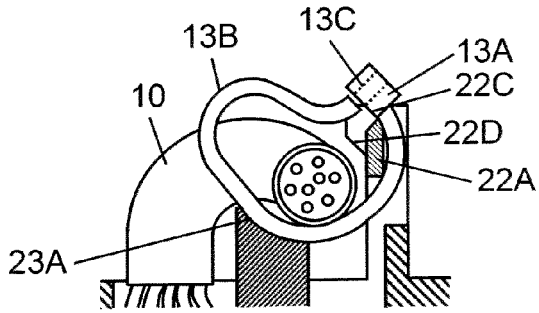
Figure 3D:
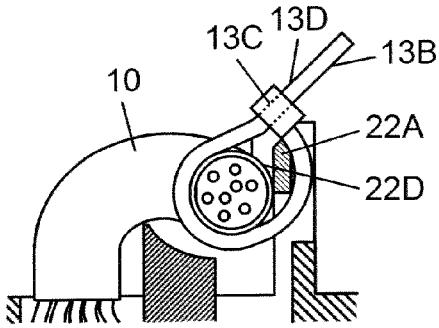
Figure 4:
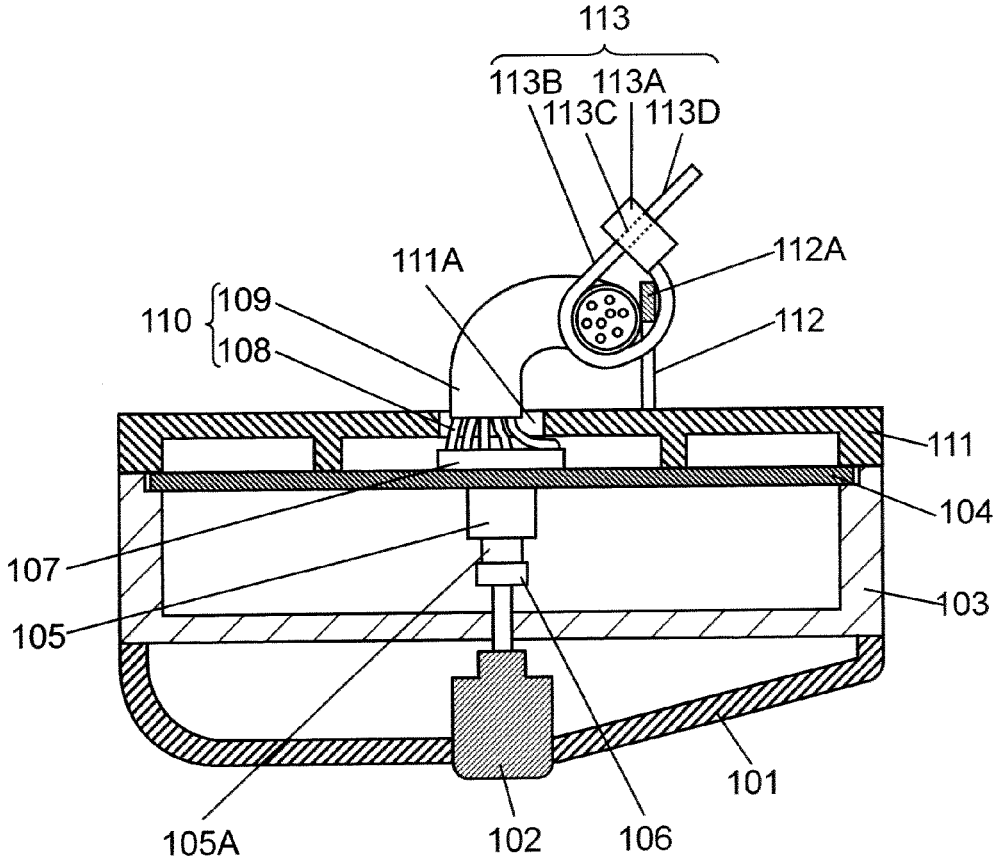
FIG. 4 PRIOR ART
FIG. 4 is a cross-sectional view of a switch device of the prior art.
Figure 5A:
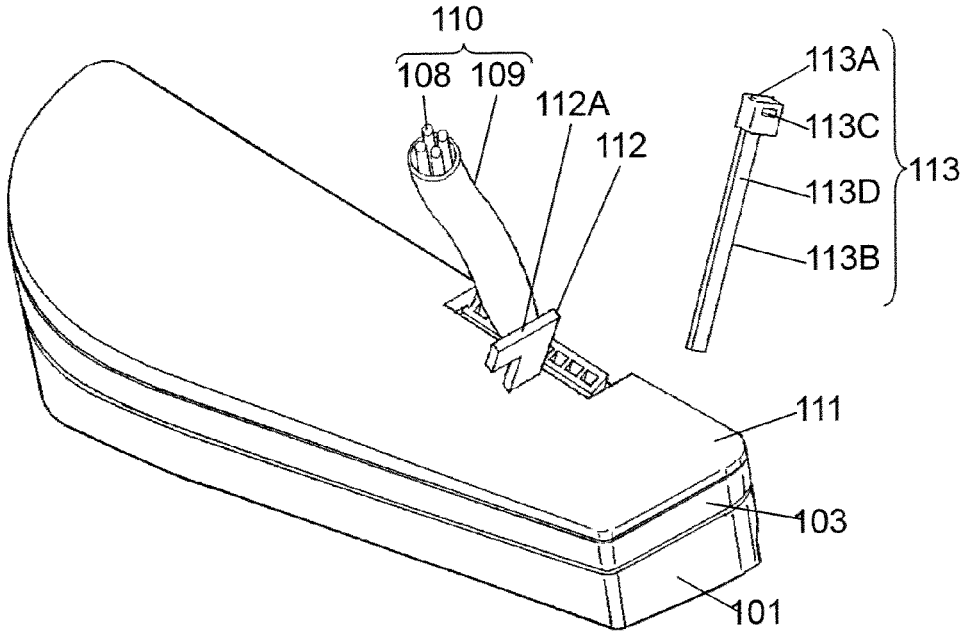
FIG. 5A PRIOR ART
FIG. 5A and FIG. 5B are perspective views of the switch device of the prior art.
Figure 5B:
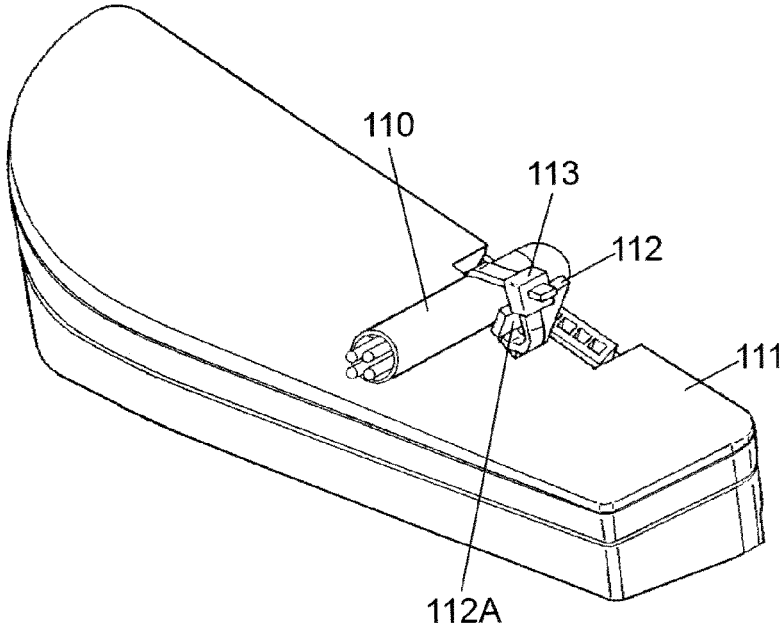
FIG. 5B PRIOR ART
Figure 6A:
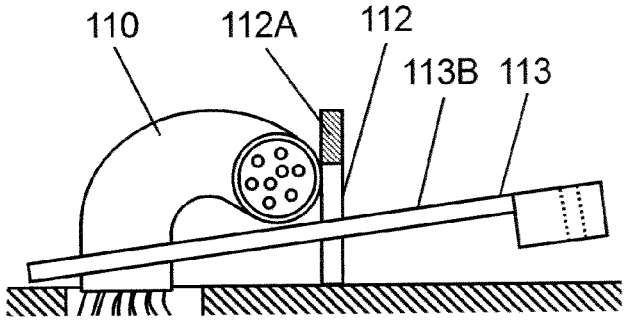
FIG. 6A PRIOR ART
FIG. 6A, FIG. 6B, and FIG. 6C are cross-sectional views of the main parts of the switch device of the prior art.
Figure 6B:
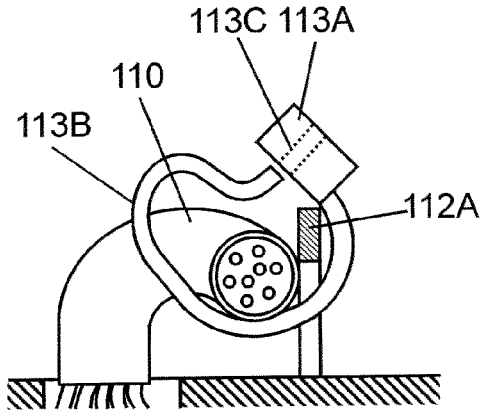
FIG. 6B PRIOR ART
Figure 6C:
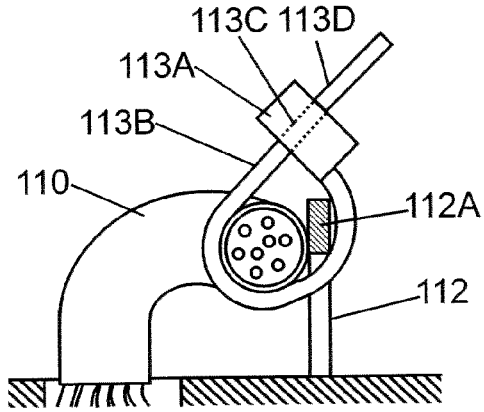
FIG. 6C PRIOR ART

As shown in FIG. 3C, the tip of band portion 13B passes through engagement hole 13C of fastener portion 13A, and fastener portion 13A is fitted to the substantially V-shaped concave portion of the upper face of holding body 22 to hold fastener portion 13A. As shown in FIG. 3D, band portion 13B is tightly fastened.

At this time, since fastener portion 13A of binding band 13 is fitted to the concave portion of holding portion 22C, the fixation of harness portion 10 to holding body 22 is reliably held by binding band 13 even when up, down, left, or right vibration is applied to the switch device. It is preferable that the fitting to the concave portion of holding portion 22C is performed at least at a part of binding band 13 that is the fixing member.

As shown in FIG. 3D, when band portion 13B wound around harness portion 10 and fixing portion 22A is tightly fastened, harness portion 10 comes into contact with support portion 22D. Lastly, locking portion 13D of binding band 13 is locked to engagement hole 13C, an unnecessary part of the tip of band portion 13B is cut off, and harness portion 10 is fixed to fixing portion 22A of holding body 22.

Guide portion 23A and support portion 22D are opposed with harness portion 10 and band portion 13B interposed therebetween. For this reason, when band portion 13B is tightly fastened, harness portion 10 rapidly comes into contact with support portion 22D and is supported by support portion 22D without moving to portions other than support portion 22D. Accordingly, it is possible to easily perform a tightly fastening operation.

Since harness portion 10 comes into contact with support portion 22D on the left side of fixing portion 22A and is fixed by binding band 13, harness portion 10 can be stably held and fixed without rotating around fixing portion 22A and becoming dislodged.

The switch device with the configuration described above is mounted, for example, on a spoke portion in the vicinity of a steering wheel. When a user operates any of the plurality of operation bodies 2 with a finger with the handle held, an electric signal corresponding to the operation is output from push switch 5 to the electronic circuit of a vehicle through the lead lines 8. Accordingly, the electronic device such as an audio device in a vehicle is controlled.

As described above, in the switch device of the embodiment, rear case 21 is provided with substantially columnar holding body 22 having fixing portion 22A protruding from the outer face of rear case 21 and provided on the tip side and through-hole 22B provided under fixing portion 22A, and substantially concave curve-shaped guide portion 23A opposed to through-hole 22B, and the lower end portion of through-hole 22B is positioned to be above the lower end portion of guide portion 23A. Binding band 13 that is the fixing member is wound around harness portion 10 and fixing portion 22A through through-hole 22B to fix harness portion 10 to holding body 22. Accordingly, band portion 13B is easily wound around harness portion 10 and fixing portion 22A, the fixing work of harness portion 10 to holding body 22 can be easily performed, and it is possible to reliably hold and fix harness portion 10.

End portion 23C of guide portion 23A far away from through-hole 22B is positioned to be above end portion 23B close to through-hole 22B. Accordingly, band portion 13B is led to a position where the user is able to operate easily.

In addition, it is preferable that the right face of fixing portion 22A and the left face of wall portion 22F of holding body 22 are formed to be positioned on the same plane perpendicular to the rear face of rear case 21. That is, the opposed sides of the side of fixing portion 22A and the side of holding body 22 are formed to be positioned on the same plane perpendicular to the rear face of rear case 21. Rear case 21 is provided with hole 22G connecting the front and back of rear case 21 between holding body 22 and guide body 23. With such a configuration, when holding body 22 and guide body 23 are formed of resin, the forming can be easily and inexpensively performed with a mold to be movable up and down. When hole 22G is not formed, it is necessary to use a horizontally movable mold in addition to a mold movable in the up and down direction when forming through-hole 22B.

In addition, it is preferable that fixing portion 22A of holding body 22 opposed to guide portion 23A of guide body 23 is provided with substantially V-shaped support portion 22D, and harness portion 10 is supported by support portion 22D. Harness portion 10 and fixing portion 22A are wound and fastened by binding band 13. For this reason, harness portion 10 is supported by substantially V-shaped support portion 22D, and thus is reliably fixed to a predetermined position of holding body 22 without becoming dislodged up, down, left, or right. As a result, the holding and the fixing of harness portion 10 are more stable.

Even when the invention described with reference to the embodiment is applied to devices other than the switch device, the same effects are obtained. Specifically, the configuration provided with holing body 22, guide body 23, and binding band 13 that is the fixing member is satisfactory, and it is possible to form a wire rod fixture for fixing various wire rods (corresponding to the harness portion of the switch device in the invention) by them.

According to the switch device of the invention, the fixing work of the harness portion to the holding body is easily performed, it is possible to realize a switch device in which the harness portion is reliably held and fixed, and the switch device according to the invention is useful mainly for a switch device used for an operation of various electronic devices in a vehicle.

What is claimed is:

1. A switch device comprising:

a box-shaped case;

an operation body that is housed in the case to expose at least a part thereof out of the case;

a switch contact point that performs electrical connection and disconnection according to an operation of the operation body;

a harness portion that is connected to the switch contact point and includes a plurality of lead lines extending out of the case; and a fixing member that fixes the harness portion extending out of the case to the case, wherein the case includes a substantially columnar holding body protruding from an outer face of the case having a fixing portion provided on a tip side, a through-hole provided under the fixing portion, and a substantially concave curve guide portion opposed to the through-hole, wherein the guide portion is formed such that an end portion farther from the through-hole is positioned above an end portion closer to the through-hole, and wherein the fixing member extends through the through-hole and fixes the harness portion to the holding body by winding the harness portion and the fixing portion together.

2. The switch device of claim 1, wherein a lower end portion of the through-hole is positioned above the end portion closer to the through-hole of the guide portion.

3. The switch device of claim 1, wherein the case further includes a guide body protruding from the outer face and having the guide portion on an upper face thereof, and a hole connecting a front and back of the case between the holding body and the guide body, and wherein opposed sides of a side of the fixing portion and a side of the holding body are formed to be positioned on a same plane perpendicular to the outer face of the case.

4. The switch device of claim 1, wherein the holding body further includes a support portion opposed to the guide portion, the support portion and the fixing portion are disposed such that they form a substantially V-shaped face, and the harness portion is supported by the support portion.

5. The switch device of claim 1, wherein the holding body further includes a recess portion on an upper face thereof, and wherein a part of the fixing member is fitted to the recess portion of the holding portion.

* * * * *